US005159882A

United States Patent [19]

Krug et al.

[11] Patent Number: 5,159,882

[45] Date of Patent: Nov. 3, 1992

[54] RAILWAY CAR UNDERBODY STRUCTURE AND METHOD

[75] Inventors: John A. Krug, St. Charles County; William L. Willis, Franklin County; Paul J. Dumser, St. Charles County; William U. Casseau, St. Louis County; William T. Deet, Franklin County; Laurence E. Culligan, St. Charles County, all of Mo.; Bruce A. Walter, Madison, Ill.

[73] Assignee: ACF Industries, Inc., Earth City, Mo.

[21] Appl. No.: 729,992

[22] Filed: Jul. 15, 1991

[51] Int. Cl.[5] ..... B61D 5/00

[52] U.S. Cl. ..... 105/362; 105/416

[58] Field of Search ..... 105/358, 362, 413, 414, 105/416, 417, 418, 419

[56] References Cited

U.S. PATENT DOCUMENTS

| | | | |
|---|---|---|---|
| 896,082 | 8/1908 | Burke | 105/417 |
| 3,529,552 | 9/1970 | Bolte et al. | 105/358 |
| 4,194,451 | 3/1980 | Dehner | 105/413 |
| 4,284,012 | 8/1981 | Hrinsin | 105/362 |
| 4,805,540 | 2/1989 | Mundloch et al. | 105/358 |
| 4,951,575 | 8/1990 | Dominguez et al. | 105/415 |

*Primary Examiner*—Robert J. Oberleitner
*Assistant Examiner*—Kevin D. Rutherford
*Attorney, Agent, or Firm*—Polster, Lieder, Woodruff & Lucchesi

[57] ABSTRACT

An improved railway car underbody support structure and method for economically constructing same. The structure includes a center sill assembly having a pair of vertically disposed side plates spaced equidistant from the longitudinal center line of the car body and extending from a coupler longitudinally inboard to a wheeled truck assembly. The truck assembly carries two laterally spaced side bearing members for bearing the load of the car body during lateral tilting of the car body. One of the improved features is a unitary metal member cut from an economically patterned metal plate. The unitary members, which are themselves free of any weld lines which may crack under the extreme loads exerted on railway cars, are welded to the underside edge of a respective side plate and welded together beneath the center line of the car body. The unitary members act as, 1) a bottom side flange to stiffen the side plates, 2) a bottom cover plate to help integrate the still and 3) as a bottom bolster support which extends over a respective side bearing member. The invention also features a mini-bolster inwardly spaced from the main bolster to distribute the car body load through the still assembly; a unique side plate upper edge configuration and weld line placement; and a pair of reinforcing bars welded beneath the end of the car body on the inside vertical surfaces of respective side plates; all to provide improved structural underbody integrity and performance.

23 Claims, 6 Drawing Sheets

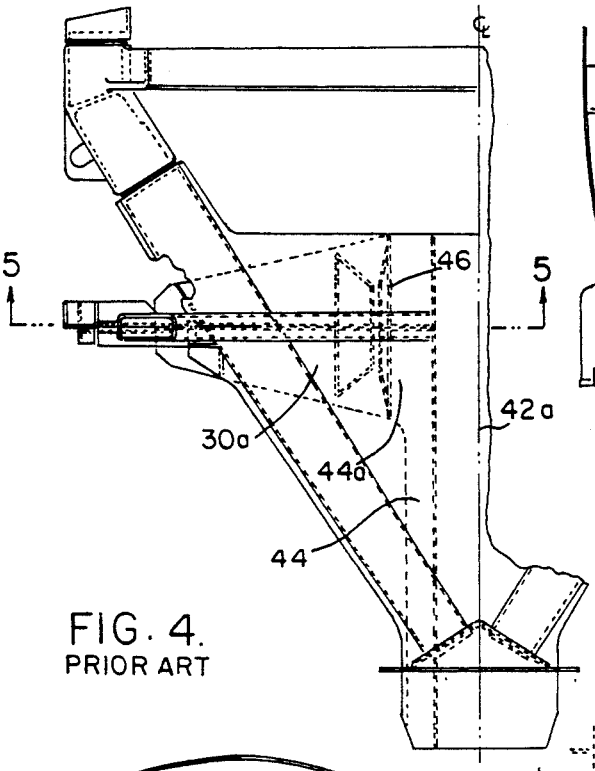
FIG. 4.
PRIOR ART
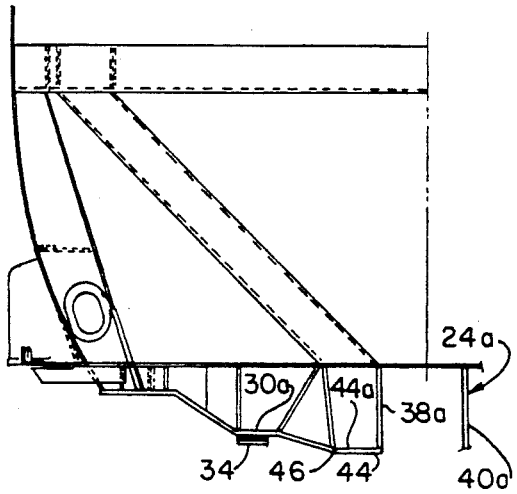
FIG. 5.
PRIOR ART.
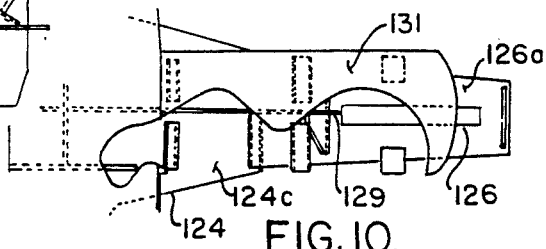
FIG. 10.
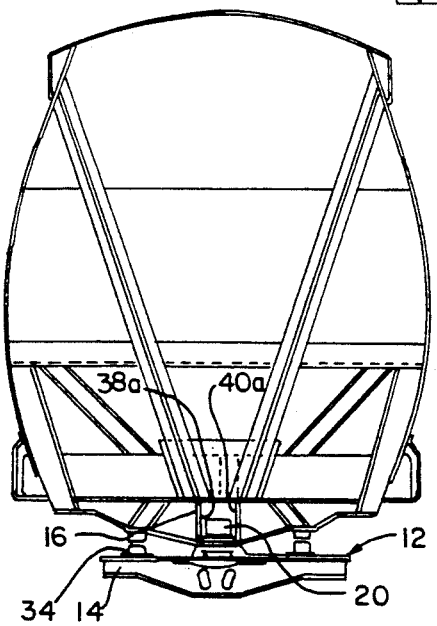
FIG. 6.
PRIOR ART.
FIG. 11.
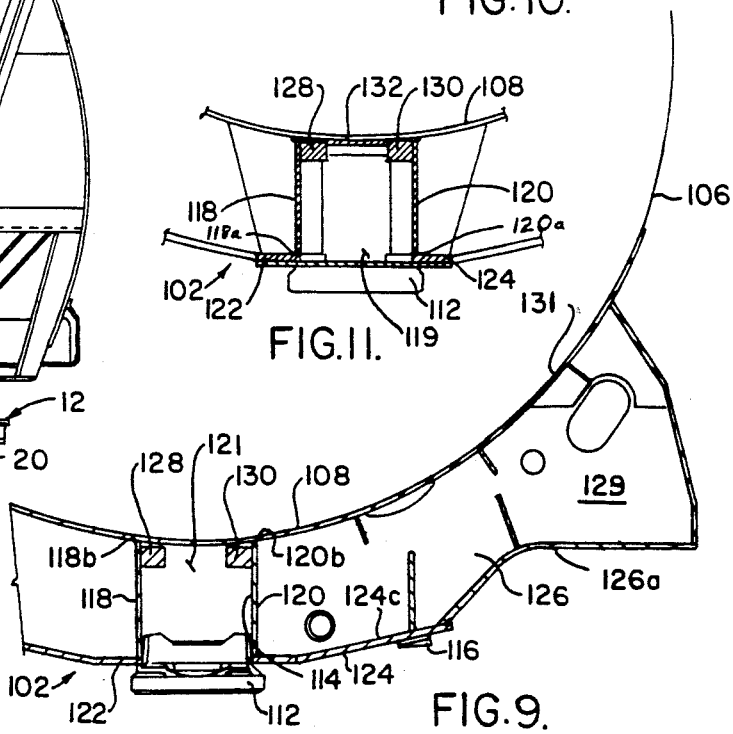
FIG. 9.

RAILWAY CAR UNDERBODY STRUCTURE AND METHOD

BACKGROUND OF THE INVENTION

The present invention relates to railway car underbody support structures. Railway cars, such as tank cars or hopper cars often utilize a pair of center stub sills for supporting the two end sections of the elongated railway car body. Each center stub sill is an elongated assembly carrying a railway car coupler assembly at the outboard end thereof and extending inboard underneath the longitudinal center line of the car to support the end of the car and to pass the longitudinal loads of draft and buff into the car body. The stub sill rides upon the center of a wheeled railway truck assembly which rolls upon the track. The stub sill carries laterally extending bolsters which support the sides of the car body, and during slight lateral tilting of the body the bolster bears upon upper side bearings located on each lateral side of the truck assembly.

The center stub sill structure is impacted by tremendous loads and passes these loads into the car body. Since the sill is connected to the body underside, large bending movements are produced at the point of outermost connection between the car body and the sill.

It has been the practice to construct the main center beam of the center sill assembly from generally Z-shaped beams welded along their abutted edge under the longitudinal center line of the car body. The bottom horizontal flange of the Z-shaped beams acted to laterally stiffen the unit while laterally outwardly extending bolster members were welded to these flanges. A more recent development in the art has been to fabricate the main center beam of the center sill from two upright side plates placed equidistant from the longitudinal center line of the car body. Separate horizontal flange members are usually welded to the bottom of the side plates and separate bolster members welded to the flange members.

Another construction has utilized a combination of the two constructions described above having an outboard end section of the main beam of the sill constructed of two Z-shaped beams and an inboard section of the main beam constructed of two side plates welded to the Z-shaped beams. This construction permits the use of a single bolster member which is welded to the underside of the side plates to support both sides of the car body above the side bearings.

Each of the prior art constructions described has the drawback of requiring a weld between separate pieces of metal plate at points which are subject to tremendous train loads and thus these weld lines present areas of potential weakness and cracking. Of course, cracking of the sill assembly may lead to shortened car life, increased maintenance and out-of-service costs, and possible failure of the assembly which may cause a derailment and personal injury. Also, the greater number of welds required to construct the sill structure, the greater the labor costs of fabrication.

The primary reason that prior art constructions have utilized a relatively large number of separate metal plate parts welded together is that it has been recognized that if a large irregularly shaped part was cut from a piece of stock metal plate an excessive amount of metal plate waste would be created, and it was therefore not economically feasible to cut such large unitary parts.

It is therefore the goal of the railway car design engineer, 1) to design the stub sill assembly to have the least number of separate parts requiring the least number of welds, 2) to locate the welds in areas of reduced load and bending movement and 3) to minimize the amount of scrap metal plate produced during cutting of the parts from stock metal plate. It is a further goal of the design engineer to produce the strongest car support structure with a minimum of material and labor costs, a minimum of material weight and improved fabrication methods to effect the goals enumerated above.

SUMMARY OF THE INVENTION

It is therefore an object of the invention to provide a novel center sill structure for a railway car having a minimum number of separate parts; a minimum number of welds between parts and the welds being located in areas of reduced train loads and bending movements; and a minimum amount of scrap metal plate.

It is another object of the invention to provide a center sill assembly requiring a minimum of material and labor costs which will produce the strongest, most durable railway car possible.

It is a still further object of the invention to provide a railway tank car end structure having a unique construction at the point of maximum bending moment between the sill assembly and the tank body.

It is another object to provide an improved car body side bolster construction.

To summarize, the present invention relates to an improved railway car underbody structure for supporting the end section of an elongated railway car body. The underbody structure has a center sill assembly beneath the longitudinal center line of the car body and carries a railway car coupler assembly on the outboard end thereof. The center sill assembly rides upon a wheeled railway truck assembly having an upper side bearing member on each lateral side thereof for bearing the load of the car body during lateral tilting of the car body. The center sill assembly includes two upright side plates spaced equidistant from the longitudinal center line of the car body and extends longitudinally from the coupler assembly inboard past the truck assembly.

A pair of unitary combination center sill bottom flange and car body bottom bolster members are welded to the bottom edge of each of a respective one of the side plates. The unitary members each have a longitudinally extending horizontally disposed flange portion extending laterally outward from a respective side plate and longitudinally from above said truck assembly toward said coupler assembly and beyond the end of the car body. The unitary members each include a bottom bolster portion in the area above the truck assembly extending laterally outwardly beyond the flange portion to at least a point over a respective one of the side bearing members, whereby the flange portions help prevent lateral bending of the side plates in the area beneath and outboard of the car body and the bolster portions help support the lateral sides of the car body in the area over the truck assembly side bearing members.

In the case of a railway tank car, the sill assembly supports an upwardly curved cradle pad. The bottom of the cradle pad is welded to the top of the side plates along parallel lines beginning adjacent the inboard end of the side plates and extending longitudinally outwardly past the longitudinal point of the side bearing members and terminating at a point short of the outboard end of the cradle pad to provide an end area of the cradle pad where no weld connection exists between the cradle pad and the sill assembly. The unitary members carry a main car body bolster assembly for supporting the lateral sides of the car body over the truck assembly and the side bearings. A secondary car body bolster is connected to the side plates inboard of the main car body bolster for further supporting the lateral sides of the car body and distributing a portion of the load of the car body through the sill. A pair of metal side bars are welded on the inside surface of a respective one of the side plates and the bars extend longitudinally from a point outboard of the car body to a point over the truck assembly to help stiffen the side plates, both laterally and vertically, at the point of maximum bending moment between the car body and the sill.

Generally speaking, the improved method comprises the step of cutting at least two unitary combination center sill bottom flange and car body bottom bolster members from metal plate according to a novel cutting pattern to reduce waste, and welding a pair of the unitary members to the bottom of each of a respective one of the side plates such that the flange portion extends generally horizontally and laterally outwardly of a respective side plate and longitudinally from the position of the coupler assembly to the bolster portion, and the bolster portion extends laterally outwardly a distance which will extend over a respective side bearing member, whereby the flange portions will help prevent lateral bending of the side plates in the area outboard of the truck assembly to the coupler assembly and the bolster portions will help support the lateral sides of the car body in the area over the truck assembly side bearing members.

These as well as other objects and advantages of the present invention will become more apparent upon a reading of the following detailed description of the preferred embodiments in conjunction with the drawings wherein:

BRIEF DESCRIPTION OF THE DRAWINGS

FIG. 4 is a partial top plan view of a second prior art center sill construction;

FIG. 5 is a cross-sectional view of the prior art center sill of FIG. 4 taken along line 5—5 of FIG. 4;

FIG. 6 is an end view of the prior art construction of FIG. 4 showing the position of the truck side bearings;

FIG. 9 is a cross-sectional view taken along line 9—9 of FIG. 7 showing the main body bolster assembly;

FIG. 10 is a top plan view showing the area of the main body bolster assembly;

FIG. 11 is a cross-sectional view taken along line 11—11 of FIG. 7;

DETAILED DESCRIPTION OF THE PREFERRED EMBODIMENTS

Figure 1:
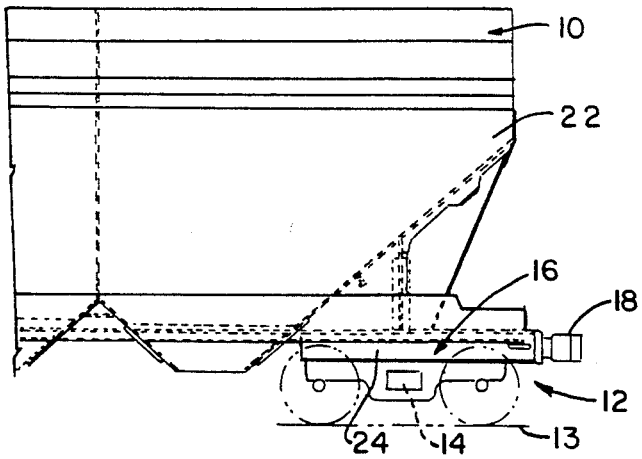
FIG. 1 is a side elevational view of one end of a railway hopper car showing the general environment of a center stub sill support structure.

With reference to the drawings and FIG. 1 in particular, there is shown for background illustration the general environment of the present improvement. FIG. 1 shows one end of a railway hopper car 10, having a wheeled truck assembly 12 including two wheels riding on track 13 positioned on each lateral side of transverse truck beam 14 (See also FIG. 6). Truck assembly 12 carries center stub sill assembly 16 having railway car coupler assembly 18 at the outboard end thereof. As best seen in prior art FIGS. 2, 3 and 6, truck beam 14 carries an upwardly extending centrally located center pin 20 which extends into center sill assembly 16 to allow truck assembly 12 to pivot with respect to sill assembly 16 when the car is traveling upon curved track. Center stub sill 16 supports the end section of the elongated railway car body 22 and includes a main longitudinally extending sill 24.

Figure 2:
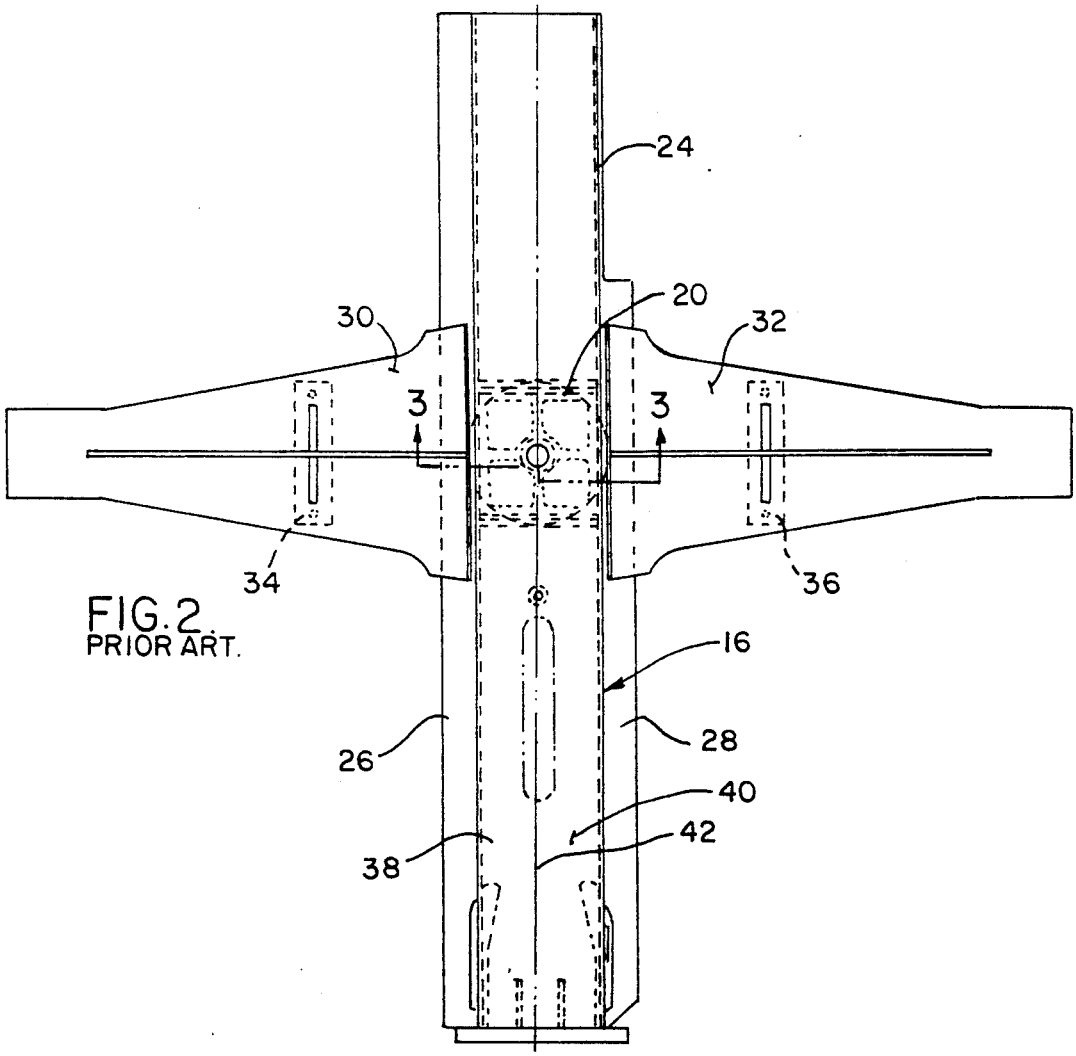
FIG.2. PRIOR ART.
FIG. 2 is a top plan view showing one prior art center sill construction.
Figure 3:
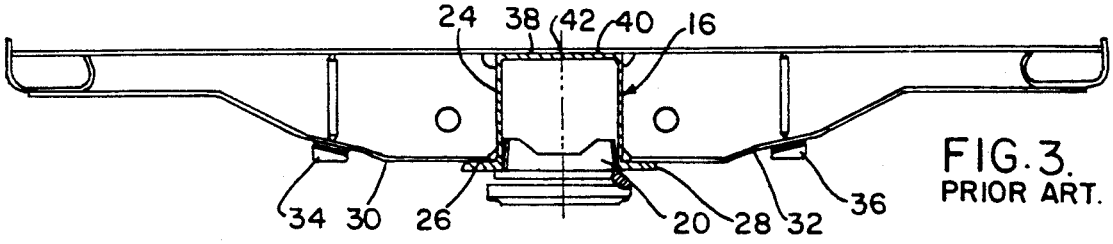
FIG.3. PRIOR ART.
FIG. 3 is a cross-sectional view of the prior art construction of FIG. 2 taken generally along line 3—3 of FIG. 2.

With reference to the prior art structure of FIGS. 2 and 3, sill 24 carries laterally outwardly extending bottom flanges 26 and 28 on the bottom of each side thereof to help stiffen sill 24 from lateral and vertical bending when subjected to very large train buff loads especially during car coupling. Also carried on center stub sill 16 at the location above truck assembly 12 are laterally outwardly extending bottom bolsters 30 and 32 which extend laterally beyond flanges 26 and 28 to help support the sides of the railway car. Bolsters 30 and 32 also extend over side bearings 34 and 36, respectively, which are positioned on the upper surface of truck assembly 12 such that bolsters 30 and 32 transfer the load of the car body to a respective side bearing during slight lateral tilting of the car body. Bolsters 30 and 32 cannot be permanently connected to side bearings 34 and 36 since truck assembly 12 pivots with respect to sill 24 and bolsters 30 and 32.

In the prior art assembly of FIGS. 2 and 3, main sill beam 24 is constructed of two generally Z-shaped beams 38 and 40 butt welded together along center line 42. Bolsters 30 and 32 are overlapped upon bottom flanges 26 and 28, respectively, and welded thereto. This construction causes twice the material to be used and a resultant increase in weight of materials at the area of the overlap of bolsters 30, 32 and bottom flanges 26, 28, respectively. Further, the force exerted by the bending moment at the point of the weld may cause cracks to develop in the weld and possible ultimate failure of the structure.

The prior art assembly shown in FIGS. 4–6 has recognized the drawbacks mentioned above and has replaced the Z-shaped beams with a main beam 24*a* fabricated of two upright side plates 38*a* and 40*a* spaced equidistant from the longitudinal center line 42*a* of the car body. Side plate 38*a* is shown to have welded to the bottom edge thereof a longitudinally extending center sill bottom flange 44. Bottom flange 44 is made slightly wider in the area 44*a* over truck assembly 12. In area 44*a*, bolster plate 30*a* which extends over side bearing 34 is butt welded along line 46. While this construction has eliminated the use of the more expensive Z-shaped beams and has eliminated the wasteful overlay joints of the bolster plate 30, 32 with bottom flanges 26, 28 of FIGS. 2 and 3, the butt weld at line 46 located in the expanse between side plate 38*a* and side bearing 34 is subject to a large bending moment which may cause cracking of the weld and possible failure of the structure. The location and size of the butt weld requires substantial manhours and attention to quality to assure a satisfactory assembly.

The present invention shown in FIGS. 7–21 eliminates the problems of the prior art. Referring specifically to FIGS. 7–13 there is shown one preferred embodiment of the improved railway car underbody structure 100 for a tank car. Structure 100 includes a center sill assembly 102 located beneath the longitudinal center line 104 of the car body 106 which is supported on cradle pad 108. Sill assembly 102 carries conventional coupler assembly 110 on the outboard end thereof. Center sill assembly 102 rides upon a conventional wheeled railway truck assembly (not shown) including an upwardly extending center pin which is inserted within and pivots with respect to sill main bearing assembly 112. Main bearing assembly 112 is located in an opening 114 of sill assembly 102. The truck assembly (not shown) includes upper side bearings 116 (FIGS. 8 and 9) on each lateral side thereof for bearing the load of car body 106 during lateral tilting thereof.

Figure 8:
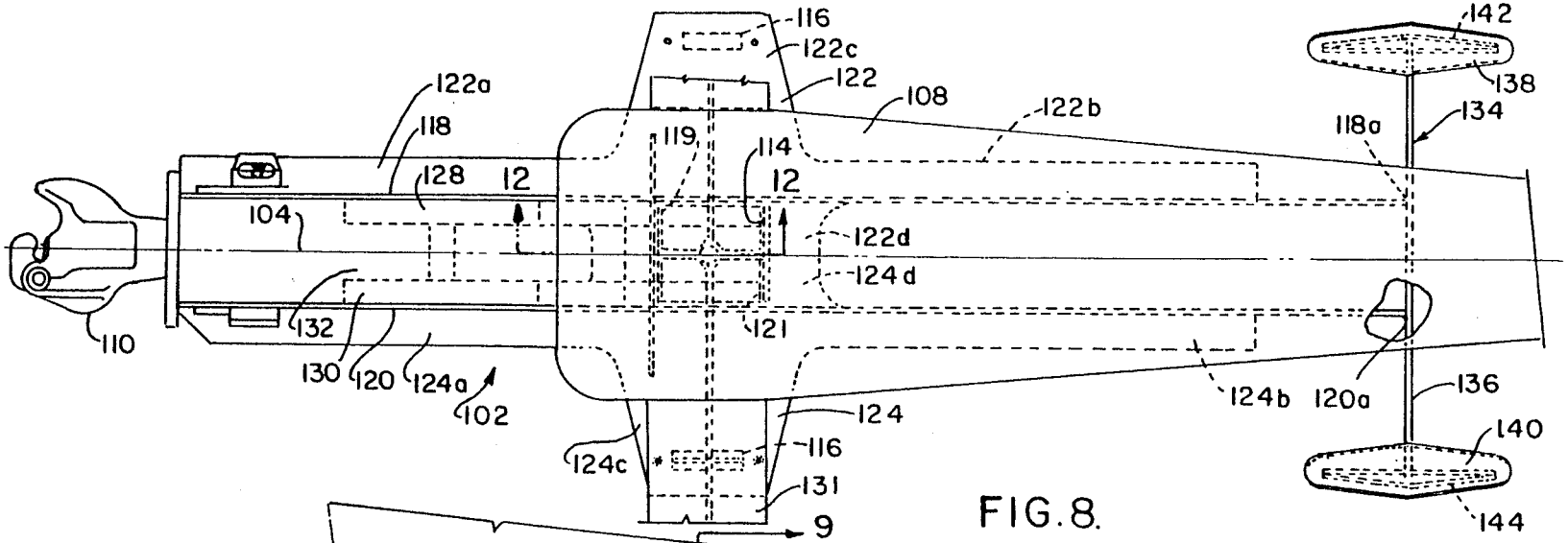
FIG. 8 is a top plan view of the assembly of FIG. 7 with the tank body removed.
Figure 16:
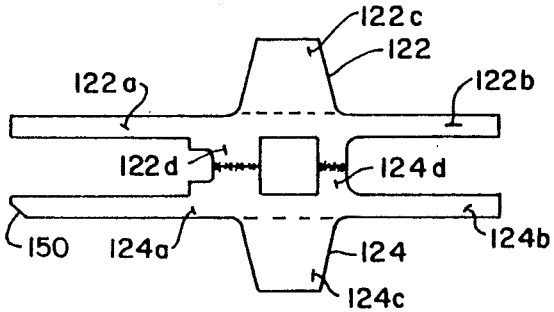
FIG. 16 shows the members of FIG. 15 after welding and cutting of weld end tabs.

Center sill assembly 102 includes two upright side plates 118 and 120 spaced equidistant from the longitudinal center line 104 of car body 106. Side plates 118 and 120 extend longitudinally from coupler assembly 110 inboard past the truck assembly to an inboard termination edge 118*a*, 120*a*, respectively. Side plates 118, 120 along with transverse plates 119, 121 create main bearing opening 114. Welded to the bottom edge of side plates 118*a* and 120*a* are a pair of unitary combination center sill bottom flange and car body bottom bolster members 122, 124, respectively; the configurations of which are best seen in FIGS. 8 and 16.

Unitary members 122, 124 each have an outboard longitudinally extending horizontally disposed flange portion 122*a*, 124*a*, respectively and an inboard longitudinally extending flange portion 122*b*, 124*b*, respectively. Flange portions 122*a*, 124*a* extend laterally outward from side plates 118, 120, respectively, and extend longitudinally from above the truck assembly toward coupler 110 and beyond car body 106.

Unitary members 122, 124 also include bottom bolster portions 122*c* 124*c*, respectively, in the area above the truck assembly and between respective flange portions 122*a*, 122*b* and 124*a*, 124*b*. Bolster portions 122*c*, 124*c* extend laterally outwardly beyond the respective flange portions and are bent upward to extend to at least a point over a respective side bearing 116. Thus, flange portions 122*a*, 124*a* help prevent lateral and vertical bending of respective side plates 118, 120 in the area beneath and outboard of car body 106; flange portions 122*b*, 124*b* help prevent lateral and vertical bending of respective side plates 118, 120 in the area inboard of bolster portions 122*c*, 124*c*; and bolster portions 122*c*, 124*c* help support the lateral sides of car body 106 in the area over the truck assembly side bearing members 116. Unitary members 122, 124 also include integral bottom cover portions 122*d*, 124*d*, respectively, which extend laterally inwardly from the bottom edge of respective side plates 118, 120. Bottom cover portions 122*d*, 124*d* are welded together beneath car body center line 104 on either side of main bearing opening 114.

As best seen in FIGS. 9 and 10, a car body bolster web assembly 126 is supported by unitary member bolster portions 122*c*, 124*c*, and includes web bottom plate 126*a* welded to bolster portion 124*c* laterally outward of side bearing 116 where the bending moment is substantially decreased on bottom bolster portion 124*c*. Web 126 also includes a plurality of substantially vertically disposed support plates, collectively referred to by numeral 129 and a top bolster plate 131 which conforms to the shape of tank body 106.

Figure 7:
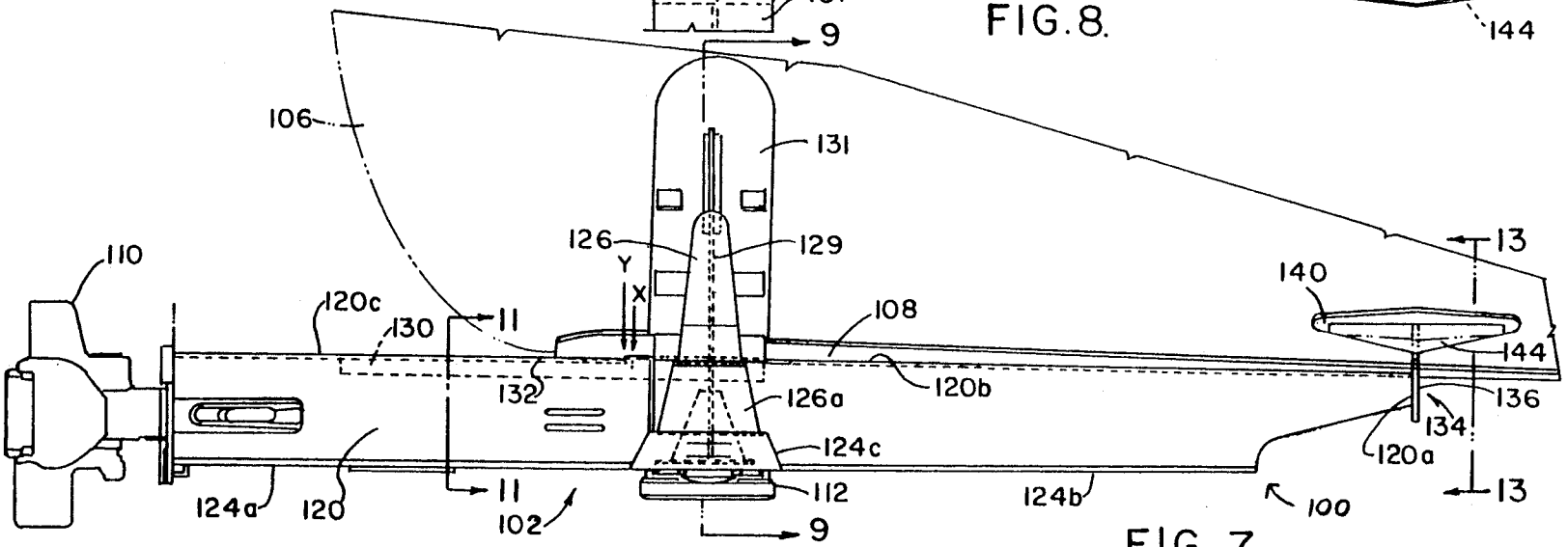
FIG. 7 is a side elevational view of a center stub sill assembly for a railway tank car according to the present invention.

As best seen in FIG. 7, side plates 118, 120 have inboard horizontal top edges 118*b*, 120*b*, respectively, which are welded to the bottom of cradle pad 108. Edges 118*b*, 120*b* are welded along parallel lines beginning at the inboard ends 118*a*, 120*a* of side plates 118, 120, respectively; and extend longitudinally outwardly past the longitudinal point of side bearings 116 and terminate at a point X, short of the outboard end of cradle pad 108. It is important that no weld connection exists between cradle pad 108 and side plates 118, 120 outboard past point X. It has been found that according to this construction it is less likely for a stress crack to begin to develop at the outboard termination of the weld connection between side plates 118, 120 and cradle pad 108 in this area of maximum bending moment between side plates 118, 120 and cradle pad 108. Slightly outboard of weld termination point X, at point Y in FIG. 7, the top edges 118*c*, 120*c* of side plates 118, 120 are depressed with respect to inboard top edges 118*b*, 120*b*. A pair of solid metal bars 128, 130 are each welded on the inside surface of respective side plates 118, 120. Bars 128, 130 extend longitudinally from a point outboard of car body 106 to a point over the truck assembly and inboard past point X which is the terminus of the weld line between side plates 118, 120 and cradle pad 108. Bars 128, 130 are vertically positioned on side plates 118, 120 such that the upper surfaces of bars 128, 130 are flush with the depressed upper edges 118*c*, 120*c* of side plates 118, 120. This permits bars 128, 130 to run horizontally beneath cradle pad 108 in close proximity to the weld lines between side plates 118, 120 and cradle pad 108 to help reinforce side plates 118, 120 in this critical area of maximum bending moment between car body 106 and sill 102. A horizontal top plate 132 is welded between side bars 128, 130 and has the upper surface thereof substantially flush with the upper surface of side bars 128, 130 to create a substantially, flat upper surface for sill assembly 102 outboard of car body 106 which will shed rain water. Top plate 132 extends longitudinally from the outboard end of side plates 118, 120 to an inboard termination no further than the point Y where the depressed upper edges of 118*c*, 120*c* of side plates 118, 120 end.

At the inboard edge of side plates 118, 120 there is welded a secondary car body bolster assembly 134. Bolster assembly 134 is comprised of a vertically disposed web plate 136 welded to the inboard ends 118*a*, 120*a* of side plates 118, 120 and which extends laterally on each side of the car body 106. Web plate 136 carries pad members 138,140 on each respective end thereof which are welded to car body 106. Pad members 138,. 140 are reinforced on web plate 136 by cross plates 142, 144, respectively. In this manner secondary bolster assembly 134 will further support the lateral sides of car body 106 and distribute a portion of the car body load through side plates 118, 120 of sill assembly 102.

Sill assembly 102 is stronger and less likely to fail in large part due to the one-piece or unitary construction of combination center sill bottom flange and car body bottom bolster members 122 and 124. These members in the past would have been uneconomical to construct due to the large amount of metal plate waste which would have been produced in cutting such large irregularly shaped members from a piece of stock metal plate.

Figure 14:
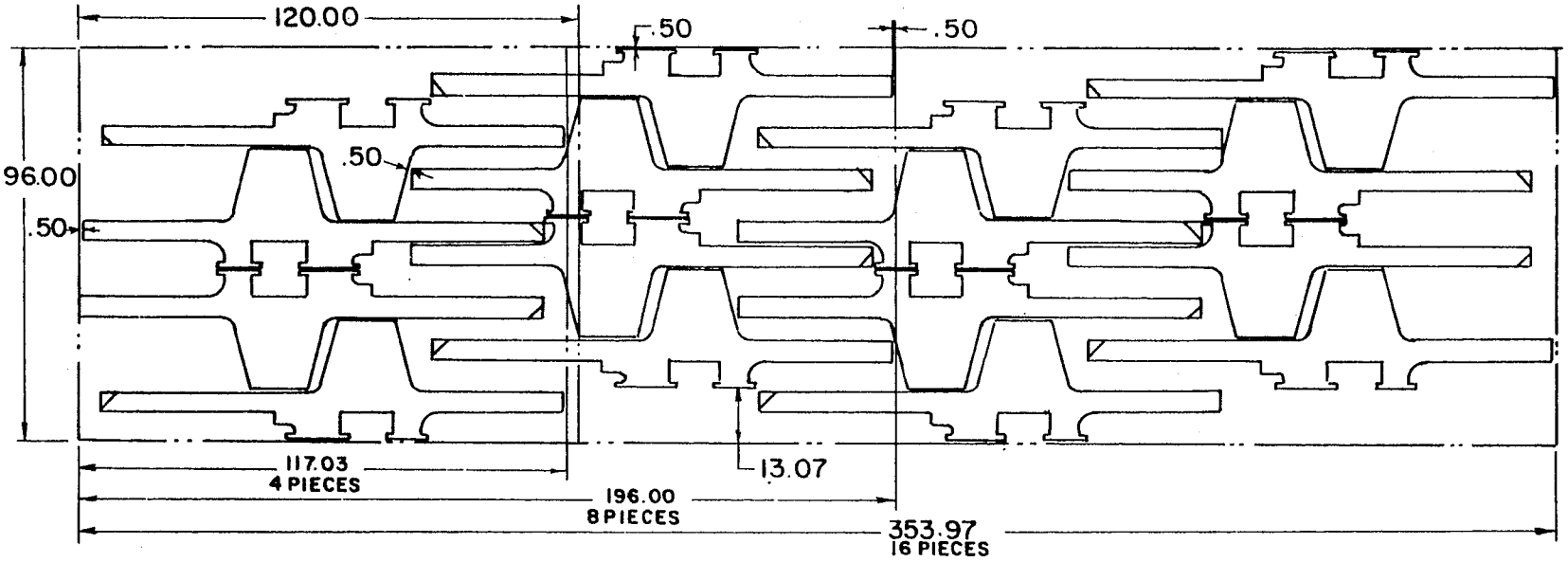
FIG. 14 is a diagramatic illustration showing the configuration of the unitary combination center sill bottom flange and car body bottom bolster members according to the principles of the present invention for a tank car, and the preferred pattern in which a plurality of identical members may be cut from a rectangle of metal plate in order to minimize material waste.
Figure 15:
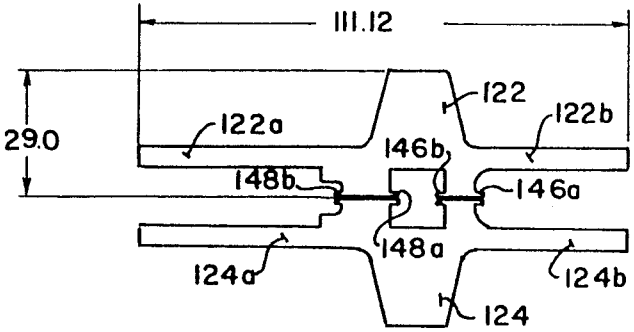
FIG. 15 shows two identical members cut from the pattern of FIG. 14 placed in position for welding.
Figure 17:
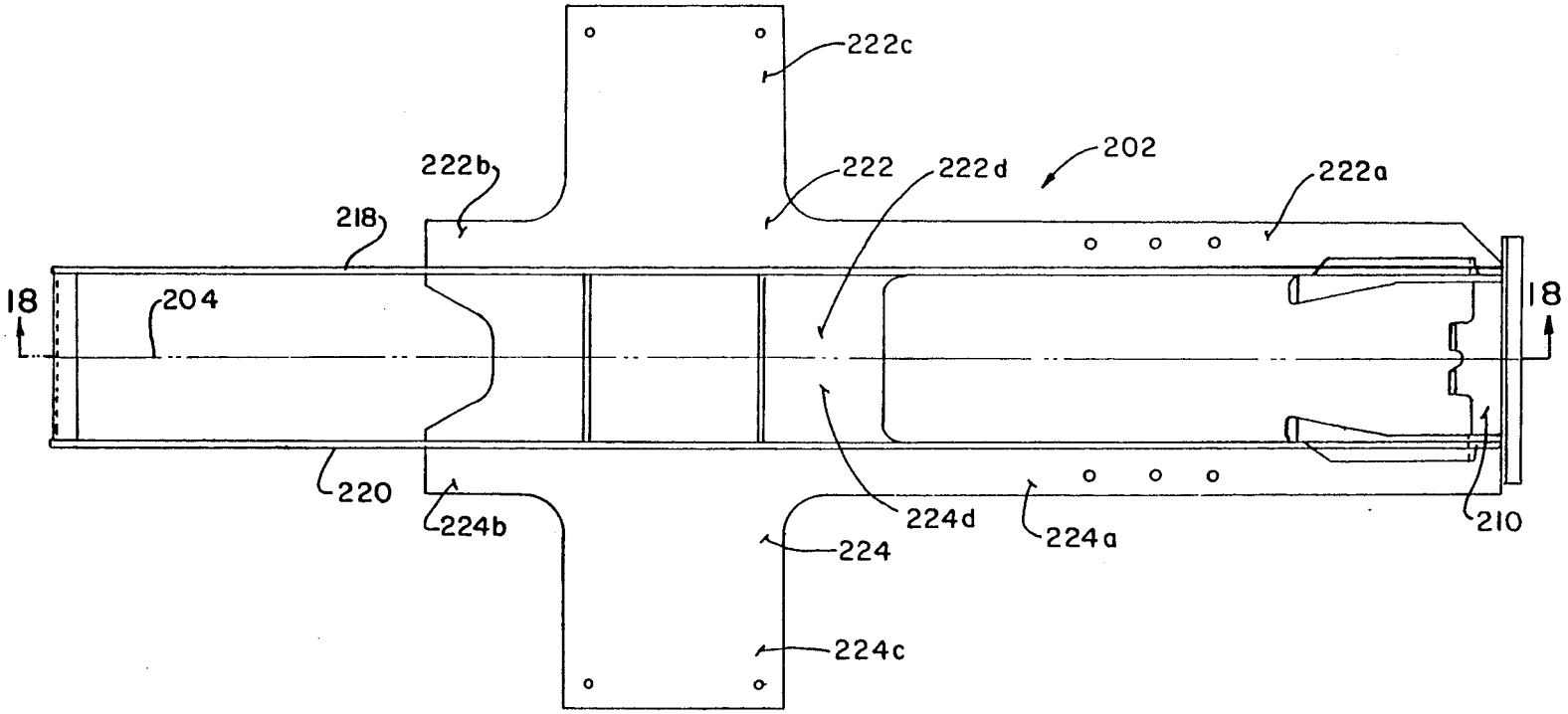
FIG. 17 is a top plan view of a center stub sill assembly for a hopper car according to the principles of the present invention.
Figure 18:
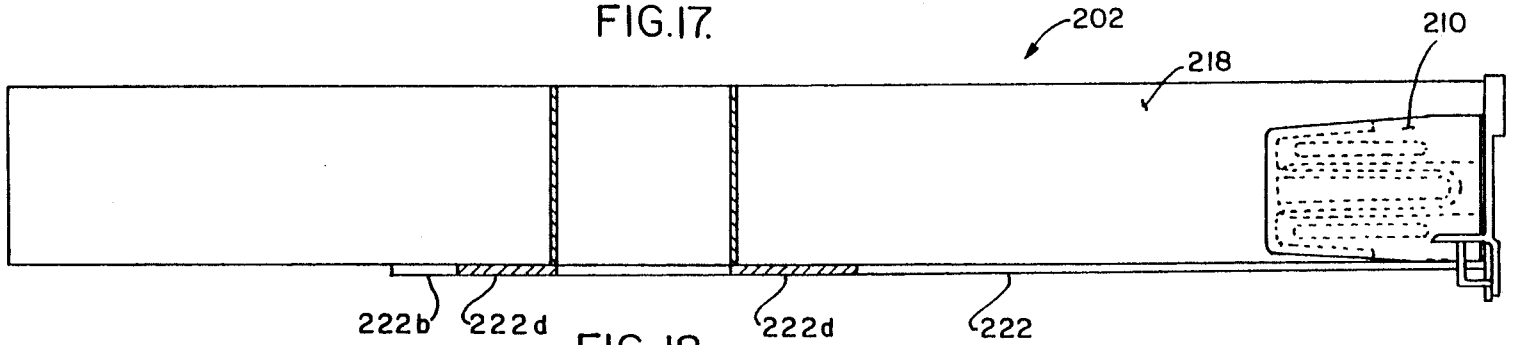
FIG. 18 is a cross-sectional view taken along line 18—18 of FIG. 17.

According to the novel method of the present invention, at least two identical unitary members 122, 124 are cut from a single metal plate in a pattern which minimizes metal plate waste. The preferred pattern for cutting unitary members 122, 124 is disclosed in the diagram of FIG. 14. Each of members 122, 124 is sized and configured such that they will uniquely intermesh to minimize waste on a rectangular piece of stock metal plate, preferably $\frac{7}{8}$ inches thick. The dimensions shown in FIGS. 14 and 15 are measured in inches; however, it should be understood that the important aspect of the invention is the increased number of unitary members which may be cut from a rectangular piece of stock metal plate and the relationship between the size of a unitary member and the size of the stock metal rectangle. In the preferred embodiment for a tank car, unitary members 122, 124 are 111.12 inches long and 29.0 inches wide. As seen in FIG. 14 four such identical unitary members may be cut from a rectangular metal plate 117.03 inches long and 96.0 inches wide. Thus the important inventive relationship is that four identical units may be cut from a rectangle of metal plate having side dimensions approximately 1.053 times the length of the unitary member by approximately 3.310 times the width of the member. FIG. 14 also shows that eight units can be cut from a metal plate 196.0 inches long and 96.0 inches wide, or approximately 1.764 times the length of the unitary member by approximately 3.310 times the width of the member. The most efficient usage of metal plate according to the pattern of the invention is the ability to cut sixteen units from a rectangle having the same 96.0 inch width by 353.97 inches long, or approximately 3.185 times the length of the unitary member by approximately 3.310 times the width of the member.

According to the method, after cutting at least two identical pieces from the stock metal plate, the two units 122, 124 are placed center to center. As seen in FIGS. 14 and 15, the units are cut including longitudinally extending inboard tabs 146*a*, 146*b* and longitudinally extending outboard tabs 148*a*, 148*b*. It has been found that if the weld lines between members 122 and 124 are started and terminated on the tabs, any weld imperfections or weakness associated with the weld starting or terminating process can be eliminated by cutting off the tabs after welding, i.e., the imperfections are cut off and discarded with the tabs leaving a stronger, more durable weld between members 122 and 124 beneath the center line of the car body. FIG. 16 depicts members 122 and 124 welded together with the tabs 146*a*, 146*b*, 148*a*, 148*b* removed and an outboard end corner 150 notched for clearance of a conventional air brake valve.

Many of the principles of the invention are also applicable to the underbody structure of a hopper car as well as a tank car. FIGS. 17–21 show an alternative embodiment of a sill assembly for a hopper car generally referred to by the reference character 202. Sill 202 includes a pair of upright, longitudinally extending side plates 218, 220 spaced equidistant from the longitudinal center line 204 of the car body (not shown) and extending from a coupler assembly 210 inboard past a truck assembly (not shown). Welded to the bottom edge of respective side plates 218, 220 are a pair of unitary combination center sill bottom flange and car body bottom bolster member 222,224. Unitary members 222, 224 include, respectively, a longitudinally extending horizontally disposed outboard flange portion 222*a*, 224*a* extending laterally outward from side plates 218, 220, respectively, and extending longitudinally from above the truck to coupler assembly 210. Unitary members 222, 224 also include relatively short inboard flange portions 222*b*, 224*b* bottom bolster portions 222*c*, 224*c* and bottom cover portions 222*d*, 224*d*. Bottom cover portions 222*d*, 224*d* are welded together beneath the longitudinal center line 204 of the car body.

Figure 19:
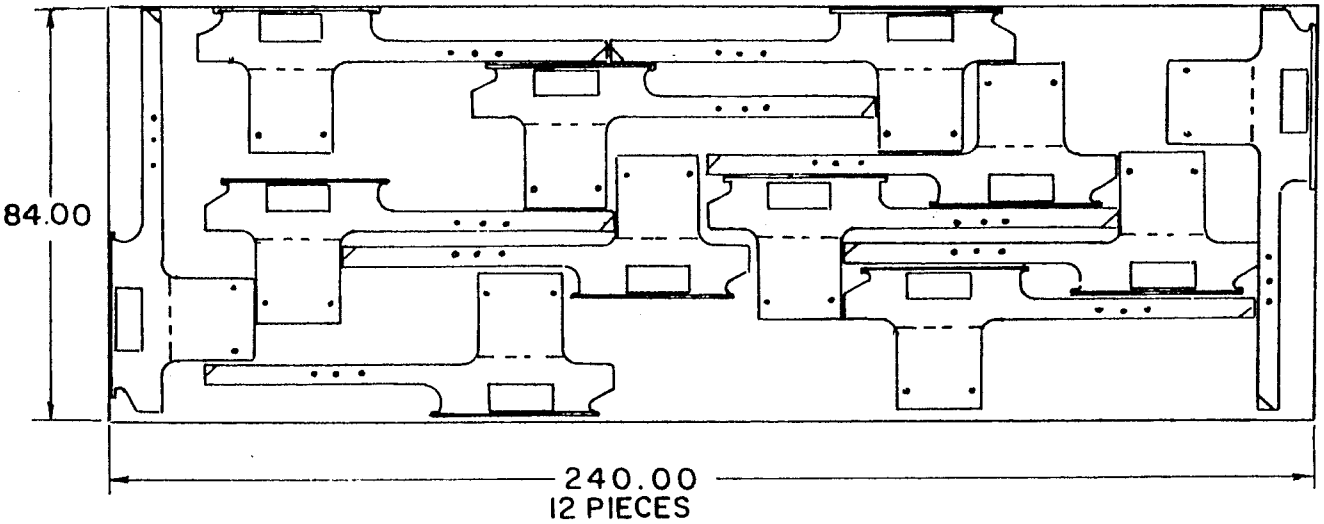
FIG. 19 is a diagramatic illustration similar to FIG. 14, except showing the preferred pattern for cutting a plurality of unitary members according to the present invention for a hopper car.
Figure 21:
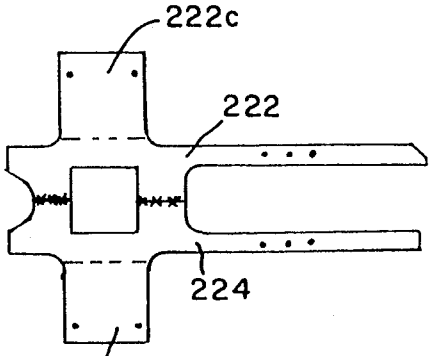
FIG. 21 shows the members of FIG. 20 after welding and cutting of weld end tabs and weld center extension.
Figure 20:
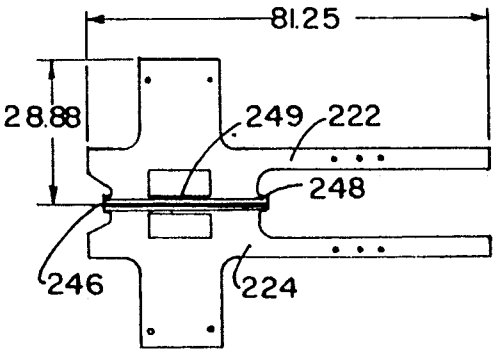
FIG. 20 shows two identical members cut from the pattern of FIG. 19 placed in position for welding.
Figure 12:
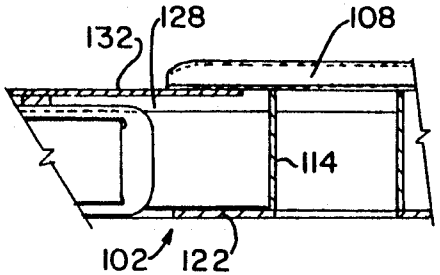
FIG. 12 is a cross-sectional view taken along line 12—12 of FIG. 8.
Figure 13:
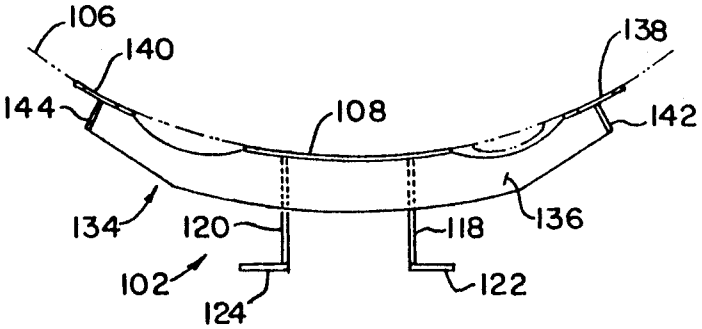
FIG. 13 is a cross-sectional view taken along line 13—13 of FIG. 7.

FIGS. 19–21 depict the preferred pattern for economically cutting unitary members 222,224. Preferably each unitary member is 81.25 inches long and 28.88 inches wide (FIG. 20). In order to minimize waste, the pattern of FIG. 19 shows that twelve identical units may be cut from a rectangle of metal plate 240.0 inches long by 84.0 inches wide, or approximately 2.954 times the length of the unitary member and approximately 2.909 times the width of the member.

Unitary members 222 and 224 when cut include an inboard tab 246 and an outboard tab 248; however the inside tabs 146*b* and 148*a* which were included in the embodiment of FIG. 15, are joined to produce a single inside tab 249 which is removed along with tabs 246,248 after welding as shown in FIG. 21 for the same reasons set forth above in regard to the embodiment of FIGS. 7–16.

It is noted that in both the tank car embodiment of FIG. 16 and the hopper car embodiment of FIG. 21, bottom bolster portions 122*c*, 124*c* and 222*c*, 224*c* respectively, are bent upwardly along the dotted lines. These bends are provided to accommodate the particular structure of the truck assemblies and the locations of side bearings 116 (FIG. 9) thereon.

It can thus be seen that the preferred railway car underbody structures described fulfill the objects and provide the advantages set forth above. Inasmuch as numerous modifications may be made to the preferred embodiments without departing from the spirit and scope of the invention, the scope of the invention is to be determined solely from the language of the following claims.

What is claimed is:

1. An improved railway car underbody structure for supporting the end section of an elongated railway car body, said underbody structure having a center sill assembly beneath the longitudinal center line of said car body, said sill carrying a railway car coupler assembly on the outboard end thereof, said center sill assembly riding upon a wheeled railway truck assembly having an upper side bearing member on each lateral side thereof for bearing the load of said car body during lateral tilting of said car body, the improvement comprising;

said center sill assembly including two upright side plates spaced equidistant from the longitudinal center line of said car body and extending longitudinally from said coupler assembly inboard past said truck assembly;

a pair of unitary combination center sill bottom flange and car body bottom bolster members welded to the bottom edge of each of a respective one of said side plates;

said unitary members each having a longitudinally extending horizontally disposed flange portion extending laterally outward from a respective side plate and extending longitudinally from above said truck assembly toward said coupler assembly and beyond the end of said car body;

said unitary members each including a bottom bolster portion in the area above said truck assembly extending laterally outwardly beyond said flange portion to at least a point over a respective one of said side bearing members, whereby said flange portions help prevent lateral bending of said side plates in the area beneath and outboard of said car body and said bolster portions help support the lateral sides of said car body in the area over said truck assembly bearing members;

said sill assembly supporting an upwardly curved cradle pad for carrying a tank car body;

the bottom of said cradle pad being welded to the top of said side plates along parallel lines beginning adjacent the inboard end of said side plates and extending longitudinally outwardly past the longitudinal point of said side bearing members and terminating at a point short of the outboard end of said cradle pad to provide an end area of said cradle pad where no weld connection exists between said cradle pad and said sill assembly;

said unitary members carrying a main car body bolster assembly for supporting the lateral sides of said car body over said truck assembly and said side bearings;

a secondary car body bolster connected to said side plates inboard of said main car body bolster for further supporting the lateral sides of said car body and distributing a portion of the load of said car body through said sill;

a pair of metal side bars each welded on the inside surface of a respective one of said side plates; and said bars extending longitudinally from a point outboard of said car body to a point over said truck assembly to help stiffen said side plates at the point of maximum bending moment between said car body and said sill.

2. An improved railway car underbody structure for supporting the end section of an elongated railway car body, said underbody structure having a center sill assembly beneath the longitudinal center line of said car body, said sill carrying a railway car coupler assembly on the outboard end thereof, said center sill assembly riding upon a wheeled railway truck assembly having an upper side bearing member on each lateral side thereof for bearing the load of said car body during lateral tilting of said car body, the improvement comprising;

said center sill assembly including two unitary upright side plates spaced equidistant from the longitudinal center line of said car body and extending longitudinally from said coupler assembly inboard to at least said truck assembly;

a pair of unitary combination center sill bottom flange and car body bottom bolster members welded to the bottom edge of each of a respective one of said side plates;

said unitary members each having a longitudinally extending horizontally disposed flange portion extending laterally outward from a respective side plate and extending longitudinally from above said truck assembly toward said coupler assembly and beyond the end of said car body; and said unitary members each also including a bottom bolster portion in the area above said truck assembly extending laterally outwardly beyond said flange portion to at least a point over a respective one of said side bearing members, whereby said flange portions help prevent lateral bending of said side plates in the area beneath and outboard of said truck assembly and said bolster portions help support the lateral sides of said car body in the area over said truck assembly bearing members.

3. The improved railway car underbody as specified in claim 2 and further comprising;

said flange portions of each of said unitary members continuing longitudinally inwardly beyond said truck assembly.

4. The improved railway car underbody as specified in claim 2 and further comprising:

said unitary members each including a bottom cover portion unitary with said flange and said bolster portions and extending laterally inwardly from the bottom edge of a respective one of said side plates; and said bottom cover portions of said pair of said unitary members being welded together beneath the longitudinal center line of said car body.

5. The improved railway car underbody as specified in claim 4 and further comprising:

said truck assembly including an upwardly extending center pin and said bottom cover portions being fabricated to form together an opening through which said center pin extends.

6. An improved railway car underbody as specified in claim 2 and further comprising:

each of said unitary members being shaped and sized such that at least four identical units of said members may be cut from a rectangle of metal plate having side dimensions approximately 1.053 times the length of said unitary member by approximately 3.310 times the width of said unitary member.

7. An improved railway car underbody as specified in claim 2 and further comprising:

each of said unitary members being shaped and sized such that eight identical units of said members may be cut from a rectangle of metal plate having side dimensions approximately 1.764 times the length of said unitary member and 3.310 times the width of said unitary member.

8. An improved railway car underbody as specified in claim 2 and further comprising:

each of said unitary members being shaped and sized such that sixteen identical units of said members may be cut from a rectangle of metal plate having side dimensions approximately 3.185 times the length of said unitary member and 3.310 times the width of said unitary member.

9. An improved railway car underbody as specified in claim 2 and further comprising:

each of said unitary members being shaped and sized such that twelve identical units of said members may be cut from a rectangle of metal plate having side dimensions approximately 2.954 times the length of said unitary member and approximately 2.909 times the width of said unitary member.

10. A method of fabricating a railway car underbody structure for supporting the end section of an elongated railway car body, said underbody structure having a center sill assembly beneath the longitudinal center line of said car body, said sill carrying a railway car coupler assembly on the outboard end thereof, said center sill assembly riding upon a wheeled railway truck assembly having an upper side bearing member on each lateral side thereof for bearing the load of said car body during lateral tilting of said car body; the method including the steps of:

placing two unitary elongated upright side plates parallel to each other and spaced equidistant from a longitudinal center line;

welding a pair of unitary combination center sill bottom flange and car body bottom bolster members to the bottom edge of each of a respective one of said side plates such that said unitary members each have a longitudinally extending horizontally disposed flange portion extending laterally outward from a respective side plate and extending longitudinally from one end of said side plates adapted to carry a coupler assembly to a respective bottom bolster portion of each of said unitary members, said bolster portion of each of said unitary members extending laterally outward past a respective flange portion; and welding said unitary members together along said longitudinal center line.

11. An improved method for constructing a railway car underbody structure for supporting the end section of an elongated railway car body, said underbody structure having a center sill assembly beneath the longitudinal center line of said car body, said sill carrying a railway car coupler assembly on the outboard end thereof, said center sill assembly riding upon a wheeled railway truck assembly having an upper side bearing member on each lateral side thereof for bearing the load of said car body during lateral tilting of said car body, said center sill assembly including two upright side plates spaced equidistant from the longitudinal center line of said car body and extending from said coupler assembly inboard to at least said truck assembly, the improved method comprising the steps of:

cutting at least two unitary combination center sill bottom flange and car body bottom bolster members from metal plate, each of said members having a longitudinally extending flange portion and a bottom bolster portion;

welding a pair of said unitary members to the bottom of each of a respective one of said side plates such that said flange portion extends generally horizontally and laterally outwardly of a respective side plate and longitudinally from the position of said coupler assembly to said bolster portion, and said bolster portion extends laterally outwardly over a respective side bearing member, whereby said flange portions will help prevent lateral bending of said side plates in the area outboard of said truck assembly to said coupler assembly and said bolster portions will help support the lateral sides of said car body in the area over said truck assembly side bearing members.

12. The improved method as specified in claim 11 and including the further step of:

welding said pair of unitary members to each other beneath the center line of said car body.

13. The improved method as specified in claim 12 wherein:

at least four identical ones of unitary members are cut from a single rectangle of metal plate having side dimensions approximately 1.053 times the length of said unitary members by approximately 3.310 times the width of said unitary member.

14. The improved method as specified in claim 12 wherein:

at least eight identical ones of said unitary members are cut from a single rectangle of metal plate having side dimensions approximately 1.764 times the length of said unitary member and 3.310 times the width of said unitary member.

15. The improved method as specified in claim 12 wherein:

at least sixteen identical ones of said unitary members are cut from a single rectangle of metal plate having side dimensions approximately 3.185 times the length of said unitary members and 3.310 times the width of said unitary member.

16. The improved method as specified in claim 12 wherein:

at least twelve identical ones of said unitary members are cut from a single rectangle of metal plate having side dimensions approximately 2.954 times the length of said unitary members and 2.909 times the width of said unitary member.

17. The improved method as specified in claim 12 including the steps of:

providing longitudinally extending inboard and outboard tabs at the center line juncture of said pair of unitary members;

welding said inboard and outboard tabs to respective inboard and outboard tabs of said pair of unitary members at the time said pair of members is being welded to each other; and cutting off said tabs to remove the ends of the weld line between said pair of members.

18. The improved method as specified in claim 17 including the steps of:

providing an opening for a truck center pin intermediate the weld lines between said pair of members by welding at least tab portions of said pair of members in said opening; and cutting off said at least tab portions which extend into the opening.

19. An improved railway car underbody structure for supporting the end section of an elongated railway car body, said underbody structure having a center sill assembly beneath the longitudinal center line of said car body, said sill carrying a railway car coupler assembly on the outboard end thereof, said center sill assembly riding upon a wheeled railway truck assembly having an upper side bearing member on each lateral side thereof for bearing the load of said car body during lateral tilting of said car body, said center sill assembly including two upright side plates spaced equidistant from the longitudinal center line of said car body and extending longitudinally from said coupler assembly inboard past said truck assembly, the improvement comprising:

said sill assembly carrying an upwardly curved cradle pad for carrying a tank car body;

the bottom of said cradle pad being welded to the top of said side plates along parallel lines beginning adjacent the inboard end of said side plates and extending longitudinally outwardly past the longitudinal point of said side bearing members and terminating at a point short of the outboard end of said cradle pad to provide an end area of said cradle pad where no weld line exists between said cradle pad and said sill assembly.

20. The improved railway car underbody structure as specified in claim 19 and further characterized by:

said end area where no weld line exists includes an outboard portion of said side plates which is depressed with respect to the upper edge of said side plates inboard of said area.

21. The improved railway car underbody structure as specified in claim 20 and further characterized by;

a pair of metal side bars, each welded on the inside surface of a respective one of said side plates; and said bars extending longitudinally from a point outboard of said car body to a point over said truck assembly and past said area of no weld line.

22. The improved railway car underbody structure as specified in claim 21 and further characterized by:

said bars being vertically positioned on said side plates such that the upper surfaces of said bars are flush with the upper edge of said side plates at the depressed outboard portions thereof.

23. The improved railway car underbody structure as specified in claim 22 and further characterized by:

a horizontal top plate welded between said side bars having an upper surface thereof substantially flush with the upper surface of said side bars; and said top plate having an inboard termination no further than the point of said side plate upper edge depression.

* * * * *